US005738006A

United States Patent [19]

Stateley

[11] Patent Number: 5,738,006

[45] Date of Patent: Apr. 14, 1998

[54] PORTABLE TRUSS REPAIR DEVICE

[76] Inventor: Kelly D. Stateley, 5399 S. Elati St., Apt. 101, Littleton, Colo. 80120

[21] Appl. No.: 654,179

[22] Filed: May 28, 1996

[51] Int. Cl.[6] ..... B30B 1/23

[52] U.S. Cl. ..... 100/233; 100/271; 100/289; 100/913

[58] Field of Search ..... 100/233, 234, 100/243, 264, 270, 271, 289, 913

[56] References Cited

U.S. PATENT DOCUMENTS

| | | | |
|---|---|---|---|
| 2,641,942 | 6/1953 | Mueller | 100/233 |
| 2,962,959 | 12/1960 | Sholin | 100/289 |
| 3,577,882 | 5/1971 | Lombard | 100/271 |
| 4,262,588 | 4/1981 | McDonald | 100/913 |
| 4,365,734 | 12/1982 | Harris | 100/913 |

*Primary Examiner*—Stephen F. Gerrity
*Attorney, Agent, or Firm*—John L. Isaac

[57] ABSTRACT

A portable press device for repairing truss joints includes jaw members spaced opposite each other having first and second end portions. A mechanism interconnects the jaw members for relative pivotal movement therebetween. A pair of plate members are disposed at the first end portions of the jaw members with the plate members facing opposite each other for receiving a truss joint therebetween. A lever arrangement is disposed at the second end portions of the jaw members to control the relative pivotal movement of the jaw members. Finally, a drive mechanism is secured to the lever members to selectively move the second end portions of the jaw members to both close and open the jaw members.

20 Claims, 2 Drawing Sheets

PORTABLE TRUSS REPAIR DEVICE

BACKGROUND OF THE INVENTION

1. Field of the Invention

The present invention relates generally to devices for forming truss structures and, more particularly, to devices designed to both manufacture as well as repair truss joints. In particular, the present invention relates to a device for repairing truss structures at a construction site.

2. Description of the Prior Art

The use of prefabricated structural truss assemblies has become increasingly widespread in recent years in view of the highly desirable load-bearing characteristics that can be achieved with the economy of mass production. Assemblies of this nature typically include a pair of spaced-apart truss chords between which extend a plurality of truss webs. Nail plate arrangements are frequently employed to provide connectors for joining the truss webs to the chords, with such arrangements including a multiplicity of teeth which are embedded in the wooden elements of the truss assembly. While the truss webs of the assembly may comprise wooden elements joined to the wooden chords with nail plates or other fastening means, the truss webs also include suitably formed metallic material including integral nail plates. Depending upon the desired configuration of the truss assembly, both metallic and wooden truss webs are employed.

Prefabrication of truss assemblies is generally effected with the use of jig-like forming machines or devices. Such machines are arranged to fabricate the desired relative positioning of the truss chords, webs, and nail plate connector portions. Once the prefabricated truss assemblies are complete, they are generally shipped to a construction site in units of sufficient number for a particular preselected housing unit design. Unfortunately, such truss assemblies often times arrive at the construction site in less than perfect condition. Frequently, some of the chords and/or webs are broken. In addition, such chords or webs may also become broken during erection and interconnection of the truss assemblies. This requires the on-site repair or replacement of such webs and/or chords. Heretofore, the broken web or chord was removed and a new one cut for replacement. Once the new web or chord has been replaced, nail connector plates must be hand nailed in order to reform the truss joint. When the trusses have already been erected in place, such hand repair of the erected and assembled truss members can be extremely cumbersome and even dangerous utilizing prior hand repair techniques. While clamps or pressure rollers are utilized in the factory assembly of the truss members, there has been a complete absence of portable units which are sufficiently light-weight to permit on-site repair of broken webs or chords.

SUMMARY OF THE INVENTION

Accordingly, it is one object of the present invention to provide a portable device for repairing truss assemblies.

It is another object of the present invention to provide a portable device for truss joint repair which is sufficiently small and light-weight to enable an operator thereof to utilize the device even when the truss assemblies are erected.

Yet another object of the present invention is to provide a portable device for truss joint repair which is adjustable for varying sized and shaped truss joint structures.

To achieve the foregoing and other objects and in accordance with the purpose of the present invention, as embodied and broadly described herein, a portable truss device for repairing truss joints includes jaw members spaced opposite each other having first and second end portions. A mechanism interconnects the jaw members for relative pivotal movement therebetween. A pair of plate members are disposed at the first end portions of the jaw members with the plate members facing opposite each other for receiving a truss joint therebetween. A lever device is disposed at the second end portions of the jaw members to control the relative pivotal movement of the jaw members. Finally, a drive mechanism is secured to the lever mechanism to selectively move the second end portions of the jaw members to both close and open the jaw members.

BRIEF DESCRIPTION OF THE DRAWINGS

The accompanying drawings which are incorporated in and form a part of the specification illustrate a preferred embodiment of the present invention and, together with a description, serve to explain the principles of the invention. In the drawings.

DETAILED DESCRIPTION OF THE PREFERRED EMBODIMENT

Figure 1:
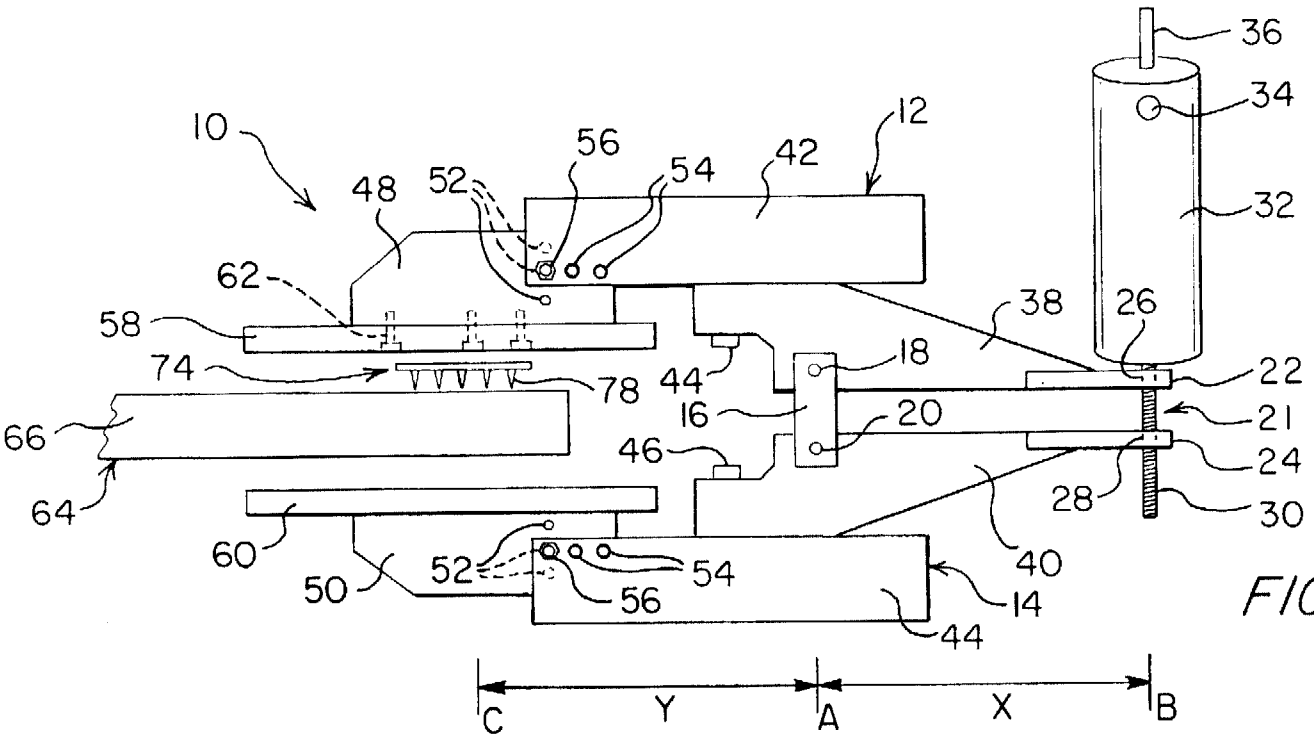
FIG. 1 is a side view of a device constructed in accordance with the present invention in its open jaw position.
Figure 3:
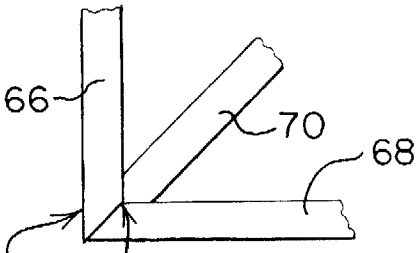
FIG. 3 is a top plan view of a truss joint requiring connection.
Figure 6:
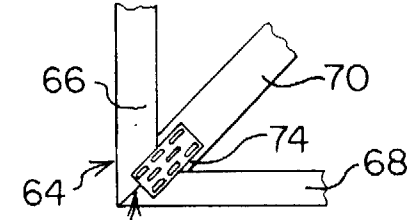
FIG. 6 is a top plan view of the truss joint illustrated in FIG. 3 having a joining plate secured thereto utilizing the device constructed in accordance with the present invention.
Figure 4:
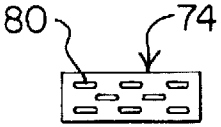
FIG. 4 is a top plan view of a joining plate typically used in truss joint construction.
Figure 5:
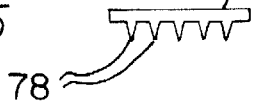
FIG. 5 is a side view of the joining plate illustrated in FIG. 4.

Referring now to FIGS. 1–6, a device 10 is designed for repairing truss joints. The device 10 is relatively light-weight and portable and as such can be used on a construction site to repair broken truss joints. Use of the device 10 to repair truss joints may take place on the ground or may take place in the air after the trusses have already been erected in a residential or commercial structure. In preferred form, the device 10 includes a pair of jaw members 12 and 14 which are disposed opposite each other and designed to hold a truss joint therebetween as described in greater detail below. The jaw members 12 and 14 are preferably interconnected by a pair of brackets 16 which are substantially aligned with each other on each side of the jaws 12 and 14. Each bracket 16 is hingedly connected at each end to the jaw members 12 and 14, respectively. More specifically, each bracket 16 includes a hinge connection 18 at the midportion of the jaw member 12 and a hinge connection 20 at the midportion of the jaw member 14. In this manner, each jaw member 12 and 14 can pivot relative to the brackets 16 as well as relative to each other. The hinged pivotal movement between the jaws 12 and 14 do not necessarily have to be uniform since each jaw member 12 and 14 pivots independent of the other jaw member.

In preferred form, the jaw members 12 and 14 are interconnected at their first or rear end portion to a lever assembly 21 preferably in the form of a pair of ear members 22 and 24. The ear member 22 is secured at one end to the first end portion of the jaw member 12, while the ear member 24 is likewise secured at one end to the first end portion of the jaw member 14. A pair of apertures 26 and 28 are disposed at the opposite ends of the ear members 22, 24 through which a screw drive member 30 passes. The threading of the apertures 26 and 28 are of opposite hands so that as the screw drive member 30 rotates in one direction, the ear members 22 and 24 move away from each other, and as the screw drive member 30 rotates in the opposite direction, the ear members 22 and 24 move toward each other. This arrangement permits the jaw members 12 and 14 to pivot about the brackets 16 as the screw drive member 30 is rotated in one direction or the other. In preferred form, a hydraulic ram 32 is provided to operate the screw drive member 30. The ram 32 may be operated by hydraulic pressure through high pressure hydraulic intake member 34 or by a mechanical rotating member utilizing drive shaft 36.

Each jaw member 12 and 14 includes a base member 38 and 40 which is secured by welding or other means to the ears 22 and 24, respectively, at one end, and are secured to the brackets 16 as illustrated in FIG. 1. The base members 38 and 40 are in turn each secured to jaw arms 42 and 44, respectively. The arm 42 may be secured to the base member 38 by ways of a bolt 44, by welding or the like. Likewise, the arm 44 may be secured to the base member 40 by a bolt 46, welding or other means of attachment. Regardless of the mechanism of securing the base members 38, 40 to their respective jaw arms 42, 44, this attachment is preferably permanent in nature so as to make the base member 38 and arm 42 a single jaw member unit while likewise making the base member 40 and the arm 44 a jaw member single unit.

Secured to the front end portion of the jaw arm 42 is a plate connector member 48. Likewise, a plate connector member 50 is secured to the forward portion of the jaw arm 44. The plate connector members 48 and 50 each include a plurality of vertically aligned apertures 52. Moreover, each of the jaw arms 42, 44 include a plurality of horizontally aligned apertures 54. A connecting member 56 interengages an aperture 54 with an aperture 52 so as to connect the arms 42, 44 to their respective plate connector members 48, 50. In order to adjust the horizontal alignment between the plate connecting members 48, 50 so as to increase or decrease the spacing therebetween, the pin connectors 56 are selectively interengaged with any of a selected one of the apertures 52. Moreover, in order to adjust the effective length of the plate connector members 48, 50 relative to the arms 42, 44, the pin connectors 56 may be interengaged with any one of the several apertures 54 as desired. In this manner, the plate connector members 48, 50 can be adjusted so as to adjust the spacing therebetween as well as to adjust length thereof relative to the arms 42, 44. This adjustment capability permits adjustability of the device 10 depending upon the size and shape of the truss joint to be repaired.

A press plate 58 is secured to the bottom portion of the plate connector member 48, and a press plate member 60 is likewise secured to the plate connecting member 50. The press plate 58, 60 are aligned substantially parallel with each other so as to provide a smooth flat surface therebetween in order to press the truss joint therebetween. The press plates 58, 60 may be secured to their respective plate connecting arms, 48, 50, in any manner known in the art such as by the use of screw attachment members 62, welding or the like. However, since the plates 58 and 60 may take on different shapes as described below, it is preferred to removably secure them to their respective connector arms 48 and 50.

Referring more particularly now to FIGS. 3–6, a typical truss member 64 includes a pair of wood support members or chords 66 and 68 and a web member 70. The juncture between the members 66, 68 and 70 form the truss joint 72. The connector plate 74, preferably made out of metal, includes a flat plate member 76 and a plurality of projections 78 which are formed by punching out portions of the metal plate 74 as indicated at 80. The connector plate 74 is placed over the truss joint 72 with the projections facing toward the wood. The truss member 64 with connector plate 74 is then positioned between the press plates 58, 60 as illustrated in FIG. 1.

Figure 2:
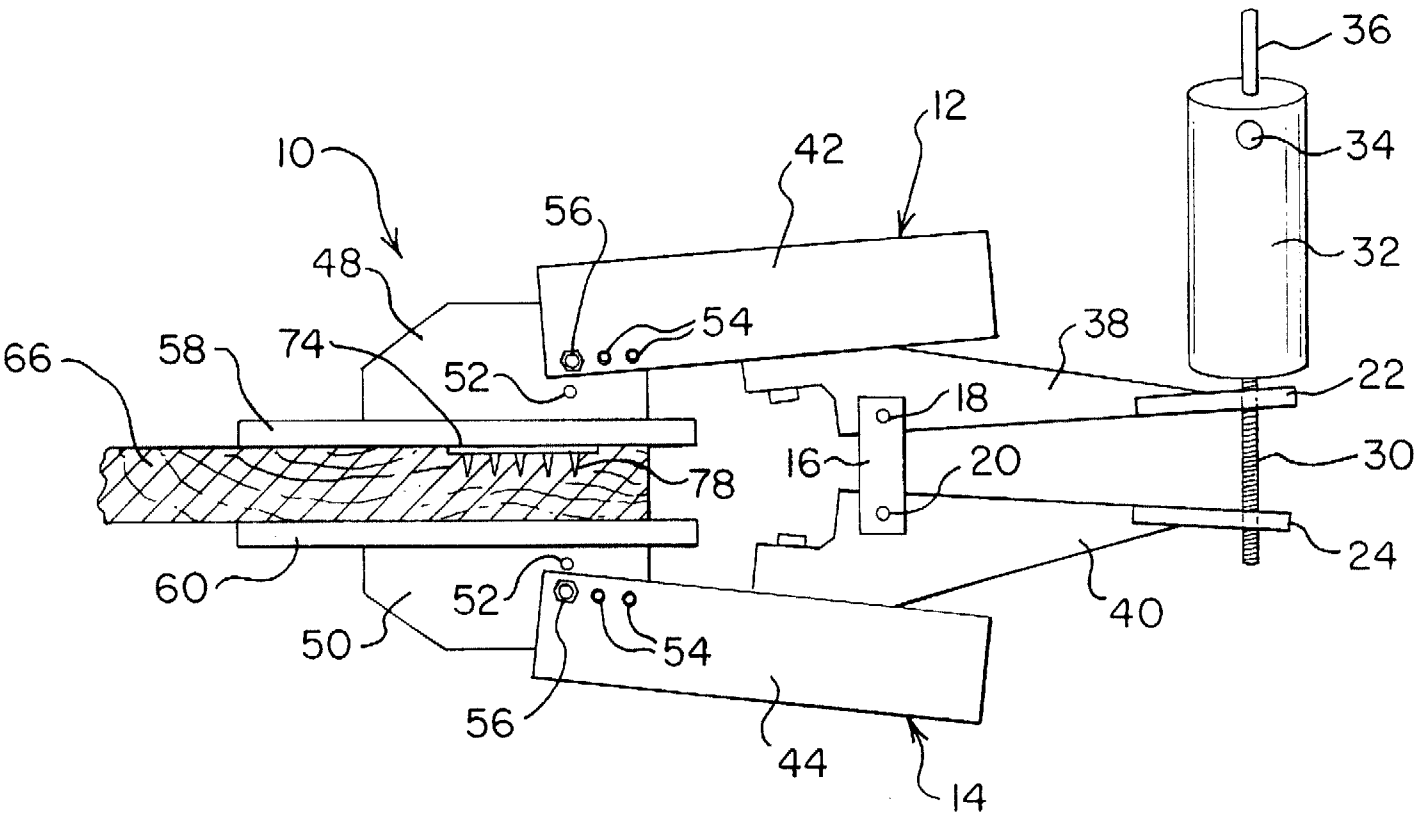
FIG. 2 is a side view of the device illustrated in FIG. 1 in its closed jaw position.

Referring now to FIGS. 1 and 2, once the truss member 64 is placed between the press plates 58 and 60, the hydraulic ram 32 is activated to rotate the screw drive member 30 so as to move the ear members 22, 24 away from each other. As the ear members 22, 24 are moved away from each other by operation of the ram 32 and screw drive 30, the jaws 12 and 14 rotate about the hinge connections 18 and 20 of the brackets 16 so as to move the press plates 58, 60 toward each other. While the press plates 58, 60 engage the truss member 64, the plate connector members 48, 50 swivel at the connecting points 56 in order to maintain the press plates 58, 60 in substantially parallel position. As the plates 58, 60 engage the metal connecting member 78, pressure from the plates 58, 60 press the metal plate member 74 into the wood members 66, 68, and 70 so as to force the projections 68 into the wood and secure the interconnecting plate member 74 in position. Once the appropriate pressure has been imposed on the truss member 64 with connecting plate 74 thereon, the ram 32 is reversed so as to reverse the rotation of the screw drive 30 to separate the press plates 58, 60. Once tho plates 58, 60 have been separated, the truss member 64 is removed therefrom in a fully connected position. Optionally, additional nails may be used through openings 80, although this is not necessary.

In preferred form, the hydraulic ram 32 is preferably operated either by an electrically driven pump or a remote nickel-cadmium energy pack. Up to 10,000 psi may be excerted between the truss plates 58, 60 by the hydraulic ram 32. However, approximately 6,000–7,000 psi is generally all that is required in most instances unless heavy-duty connector plates are utilized. It should also be understood that the press plates or platen 58, 60 may be of a variety of different shapes and designs depending on the type of truss joints which are being repaired. Preferably, a rectangular plate of 4 inches by 8 inches or 6 inches by 8 inches is preferred. However, a triangular plate may also be attached to the plate connector members 48, 50 for different application. It should also be noted that the distance X from the hinge pin 16, designated as point A, to the screw drive member 30, designated as point B should be approximately equal to the distance Y from the hinge pin 16 to the midportion of the press plates 58, 60, designated as point C. In this manner, stress load on the hinge pins 18, 20 of the brackets 16 is kept at a minimum. If the distance Y is longer than the distance X, this will increase the stress load on the pins 18, 20. If the distance Y is shorter than the distance X, this will reduce the work surface inasmuch as the truss member 64 may not get placed at the center of the platen 58, 60. Moreover, the car members 22, 24 must be of sufficient size and strength to prevent them from being sheared when the pressure is exerted through the ear members 22, 24 to the jaws 12, 14 when pressing the connection plates 74 into the truss member 64.

Before the advent of the present invention, broken trusses on a construction site were repaired by removing the old broken web or chord, cutting a new web or chord for replacement, and then using ½ inch plywood gussets instead of metal connecting plates which had been installed at the factory. With the present invention, however, the connector plates 74 can be tacked lightly onto the truss member 64 and then pressed forcibly into place to securely connect the truss joint 72. Is should be understood that the connector plate 74 can be simultaneously pressed onto both sides of the truss joint 72 if desired, although only one side is illustrated in FIGS. 1 and 2. With use of the present invention, a portable pressing device is available for repairing truss joints on site at a construction area or even after the truss member has been put into position on a housing structure. In this instance, the device of the present invention is sufficiently light-weight so that a harness or belt secured thereto will permit a single user to operate the device even when the truss assembly is in place, for example as part of a roofing structure. The trusses can be repaired "on site" and in place without having to remove the truss from the roof, and then replace it with another truss in its entirety. The device of the present invention may also be operated utilizing a mechanical screw member such as an electric drill secured to the hydraulic ram, or it can be operated with a hydraulic pump.

In either event, the present invention may be easily utilized on a construction site to quickly repair trusses. In this manner, substantial expense is avoided by repairing trusses "on site" rather than having to replace the trusses with new factory made trusses or to go through extensive hand repairs, which repairs are still not as effective and as efficient as repairs made by use of the present invention. Consequently, the present invention saves substantial time and money in repairing truss joint assemblies and is easy to use and operate on site and even in an elevated position.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A portable press device for repairing truss joints comprising:

jaw members spaced opposite each other and including first and second end portions;

means for interconnecting said jaw members for relative pivotal movement therebetween including a pair of independently operating, spaced bracket plates each of which is pivotally secured at opposite ends to said jaw members to permit relative pivotal and relative longitudinal movement between said jaw members;

a pair of plate members each disposed at a first end portion of one said jaw member, said plate members facing opposite each other for receiving a truss joint therebetween;

lever means disposed at the second end portions of said jaw members to control the relative pivotal movement of said jaw members; and drive means secured to said lever means to selectively move said second end portions in opposing directions to both close and open said jaw members.

2. The device as claimed in claim 1, wherein said jaw member interconnecting means provide independent pivotal movement of each said jaw member relative thereto.

3. The device as claimed in claim 1, wherein said jaw member interconnection means are disposed proximate the center portion of said jaw members.

4. The device as claimed in claim 1, wherein said plate members are pivotally secured to each said jaw member to provide an even distribution of pressure across said plate members when said jaw members are closed against a truss joint.

5. The device as claimed in claim 1, wherein each said plate member is adjustably secured to said jaw member to adjust the spacing range between said plate members when said jaw members are in said open position.

6. The device as claimed in claim 1, wherein said lower means comprises a pair of ear members spaced opposite each other with each said ear member secured at one end to a second end portion of said jaw member, said ear members including means to receive said drive means to vary the gap between said ear members to open and close said jaw members.

7. The device as claimed in claim 6, wherein said drive means includes a screw drive member, and wherein said ear members each includes a threaded aperture to receive said screw drive member, the threading of said apertures disposed in said ear members being opposite each other to move said ear members vertically in opposite directions from and toward each other upon operation of said screw drive member.

8. The device as claimed in claim 1, wherein said drive means includes an hydraulic ram member for operating said lever means.

9. The device as claimed in claim 8, wherein said drive means includes a screw drive member, and said lever means comprise a pair of ear members each secured to a second end portion of said jaw member and each having a threaded aperture for receiving said screw drive member, the threading of the apertures in said ear members being opposite each other vertically.

10. A portable press device for repairing truss joints comprising:

a pair of jaw members spaced opposite each other and including first and second end portions, said jaw members being arranged to move said first end portions between an open position wherein said first end portions are at a maximum spacing therebetween, and a closed position wherein said first end portions are disposed proximate each other with minimum spacing therebetween;

means interconnecting said jaw members for pivotal movement relative to each other as well as to said jaw member interconnection means;

a pair of press plates disposed at said first end portions of said jaw members, said press plates facing opposite each other and arranged for pressing against a truss joint disposed therebetween when said jaw members are moved to said closed positions;

lever means including a pair of ears disposed at said second end portions of said jaw members spaced opposite each other for controlling the pivotal movement of said jaw members between said open and said closed positions, said ears each including threaded apertures with the threading being opposite each other; and drive means secured to said lever means for selectively moving said second end portions to move said jaw members between said open and said closed positions, said drive means including a screw drive member engageable with said oppositely threaded apertures to move said ears vertically in opposite directions from each other in response to operation of said screw drive member.

11. The device as claimed in claim 10, wherein said jaw member interconnection means comprises a pair of spaced brackets each pivotally secured at each end to the midportion of one said jaw member to provide said pivotal movement between said jaw members.

12. The device as claimed in claim 11, wherein said brackets sandwich said jaw members.

13. The device as claimed in claim 10, wherein said press plates are each adjustably secured to said jaw member first end portions to provide variable spacing therebetween.

14. The device as claimed in claim 10, wherein said drive means comprises an hydraulic ram member arranged to operate said screw drive member.

15. The device as claimed in claim 10, wherein said jaw members include means for selectively adjusting the length thereof.

16. A portable device for forming a truss joint between adjacent wood members using a joining plate have a plurality of projections extending from one side thereof, said device comprising:

a pair of jaw members spaced opposite each other having first and second end portions, said jaw members being arranged to move said first end portions between an open position sized to receive said wood members and joining plate therebetween, and a closed position sized to sandwich and create pressure between said joining plate and said wood members;

means interconnecting said jaw members for pivotal movement relative to each other as well as to said jaw member interconnection means;

means for selectively adjusting the length of said jaw members;

a pair of press plates disposed at said first end portions of said jaw members facing opposite each other, said press plates being sized and arranged for pressing said joint member projections into said wood members to create said truss joint upon movement of said jaw members to said closed position;

lever means disposed at said second end portions of said jaw members for controlling the pivotal movement of said jaw members between said open and closed positions; and drive means secured to said lever means for selectively moving said second end portions in opposing directions to move said jaw members between said open and closed positions.

17. The device as claimed in claim 16 wherein said jaw member interconnection means comprises a pair of spaced brackets to sandwich said jaw members, with each said bracket pivotally secured at each end to the midportion of one said jaw member to provide said pivotal movement between said jaw members.

18. The device as claimed in claim 16, wherein said press plates include means for adjusting the vertical position of said press plates relative to said jaw members to provide selective variable spacing between said press plates.

19. The device as claimed in claim 16 wherein said drive means includes a screw drive member, and said lever means comprises a pair of dog ears spaced opposite each other with one end portion of each said dog ear being secured to one second end portion of a jaw member, said dog ears including threaded apertures therein to receive said screw drive member with the threading of said apertures being opposite each other to move said dog ears vertically in opposite directions from each other in response to rotation of said screw drive member with the enclosed said jaw members.

20. The device as claimed in claim 19, wherein said drive means comprises a hydraulic ram sized and shaped to operate said screw drive member.

* * * * *